US007260864B1

(12) United States Patent
Morad

(10) Patent No.: US 7,260,864 B1
(45) Date of Patent: Aug. 28, 2007

(54) ATTACHMENT MECHANISM TO REMOVABLY AND SECURELY RETAIN A CLEANING IMPLEMENT ATTACHMENT ON A WRINGER MOP

(75) Inventor: Fred I. Morad, Toluca Lake, CA (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 637 days.

(21) Appl. No.: 10/855,289

(22) Filed: May 26, 2004

(51) Int. Cl.
*A47L 13/12* (2006.01)

(52) U.S. Cl. ..... 15/116.2; 15/115; 15/116.1; 15/118

(58) Field of Classification Search ..... 15/115, 15/116.1, 116.2, 118, 119.1, 119.2
See application file for complete search history.

(56) References Cited

U.S. PATENT DOCUMENTS

| | | | | |
|---|---|---|---|---|
| 1,462,829 | A | 7/1923 | Roberts | |
| 2,701,888 | A | 2/1955 | Vosbikian | |
| 2,895,152 | A | 7/1959 | Vosbikian | |
| 2,916,754 | A | 12/1959 | Zottola | |
| 4,604,767 | A | 8/1986 | Burkhart | |
| 4,654,920 | A | 4/1987 | O'Neil | |
| D290,892 | S | 7/1987 | Slany | |
| D295,912 | S | 5/1988 | Jones | |
| 5,483,720 | A | 1/1996 | Decoopman | |
| 5,488,750 | A | 2/1996 | Vosbikian | |
| D420,775 | S | 2/2000 | Petner | |
| 6,085,378 | A | 7/2000 | Petner | |
| 6,178,581 | B1 | 1/2001 | Lewis | |
| RE37,415 | E | 10/2001 | Petner | |
| 6,336,240 | B1 | 1/2002 | Laux | |
| 6,588,045 | B2 | 7/2003 | Fernandez | |
| 6,698,056 | B1 | 3/2004 | Oretti | |
| 2004/0016072 | A1* | 1/2004 | Libman et al. | 15/116.2 |
| 2005/0150069 | A1* | 7/2005 | Specht et al. | 15/116.2 |

FOREIGN PATENT DOCUMENTS

| | | |
|---|---|---|
| EP | 1142526 | 11/2000 |
| WO | WO 01/03566 | 1/2001 |

* cited by examiner

*Primary Examiner*—Mark Spisich
(74) *Attorney, Agent, or Firm*—Thomas I. Rozsa; Tony D. Chen

(57) ABSTRACT

A cleaning attachment which removably holds the cleaning implement such as a scrubber pad or a scrub brush in place on a wringer mop head and will not fall off during the vigorous scrubbing or brushing action because it is locked in place by means of a novel attaching mechanism. The present invention is comprised of a receiving channel affixed to the mop head, the channel receiving the unique locking members of the present invention attachment mechanism. The attachment comprises an elongated base member which on one side either permanently or removably retains a scrubber pad. On the opposite side, the base comprises the locking members which are three snap wings, one extending in one direction and the other two extending in the opposite direction, so that when the snap wings are received within the receiving channel, the snap wings are snapped into and retained within the receiving channel with the wings abutting opposite elongated upper walls within the channel of the receiving member to lock the base in place within the channel.

57 Claims, 4 Drawing Sheets

ATTACHMENT MECHANISM TO REMOVABLY AND SECURELY RETAIN A CLEANING IMPLEMENT ATTACHMENT ON A WRINGER MOP

BACKGROUND OF THE INVENTION

1. Field of the Invention

The present invention relates to wringer mops and more particularly to a wringer mop which is provided with a cleaning implement such as a scrubber pad or scrub brush to thereby enable the mop to be used to perform the dual function of washing a floor with a mop in the normal manner, and alternatively to remove soil resistant to removal by washing by applying an abrasive surface to the floor or wall being cleaned.

2. Description of the Prior Art

In general, wringer mops with scrubber attachments are known in the prior art. The following twenty patents are relevant to the field of the present invention.

1. U.S. Pat. No. 1,462,829 issued to Roberts on Jul. 24, 1923 for "Scraper Attachment For Brooms" (hereafter the "Roberts Patent");

2. U.S. Pat. No. 2,701,888 issued to Vosbikian on Feb. 15, 1955 for "Detachable Bracket For Mops With Cleaning Material" (hereafter the "'888 Vosbikian Patent");

3. U.S. Pat. No. 2,895,152 issued to Vosbikian on Jul. 21, 1959 for "Mops With Replaceable Mop Heads And Extractor Mechanism" (hereafter the" '152 Vosbikian Patent");

4. U.S. Pat. No. 2,916,754 Issued to Zottola on Dec. 15, 1959 for "Mop With Cam Wringer" (hereafter the "Zottola Patent");

5. U.S. Pat. No. 4,604,767 issued to Burkhart on Aug. 12, 1986 for "Wringer Mop" (hereafter the "Burkhart Patent");

6. U.S. Pat. No. 4,654,920 issued to O'Neil on Apr. 7, 1987 for "Sponge Mop With Scrubber Attachment" (hereafter the "O'Neil Patent");

7. U.S. Pat. No. Des. 295,912 issued to Jones on May 24, 1988 for "Wringer Mop Head With Scrubber" (hereafter the "Jones Patent");

8. U.S. Pat. No. 5,483,720 issued to Decoopman on Jan. 16, 1996 for "Sponge Mop" (hereafter the "Decoopman Patent");

9. U.S. Pat. No. 5,488,750 issued to Vosbikian on Feb. 6, 1996 for "Sponge Mop Attachment" (hereafter the "'750 Vosbikian Patent");

10. U.S. Pat. No. Des. 420,775 issued to Petner on Feb. 15, 2000 for "Butterfly Sponge Mop With Integral Molded Head" (hereafter the "'775 Petner Patent");

11. U.S. Pat. No. 6,085,378 issued to Petner on Jul. 11, 2000 for "Self-Wringing Swab Mop With Scrubber" (hereafter the "'378 Petner Patent");

12. U.S. Pat. No. 6,178,581 B1 issued to Lewis on Jan. 30, 2001 for "Mop Scrubber Adapter" (hereafter the "Lewis Patent");

13. United States Reissued U.S. Pat. No. RE37,415 E issued to Petner on Oct. 23, 2001 for "Cam Actuated Roller Mop With Scrubber Attachment" (hereafter the "Reissue Petner Patent");

14. No. U.S. Pat. No. 6,336,240 B1 issued to Laux on Jan. 8, 2002 for "Modular Sponge Mop" (hereafter the "Laux Patent");

15. U.S. Pat. No. 6,588,045 B2 issued to Fernandez on Jul. 8, 2003 for "Roller Self-Wringing Sponge Mop With Scrubber" (hereafter the "Fernandez Patent");

16. United States Patent Application Publication No. US 2004/0016072 A1 to Libman on Jan. 29, 2004 for "Wringer Mop With Removable Mop Head" (hereafter the "Libman Patent");

17. No. U.S. Pat. No. 6,698,056 B1 issued to Oretti on Mar. 2, 2004 for "Butterfly Sponge Mop With Angle-Adjustable Handle" (hereafter the "Oretti Patent");

18. EP Application No. EP 1 142 526 A1 filed on Nov. 30, 2000 for "Wringer Mop With Removable Mop Head";

19. U.S. Pat. No. Des. 290,892 issued on Jul. 14, 1987 to Slany for "Combined Floor Scrubber And Mop" (hereafter "Slany Patent");

20. WIPO Patent WO 0/03566 A1 to Petner and assigned to Quickie Manufacturing Corporation (hereafter "Patent WO-01/03566 A1).

The Roberts Patent which issued in 1923 is a scraper attachment for brooms. Specifically focusing on FIG. 1 and on the second column on the first page beginning on Line 64 it states "Bar 6 on both of the edges of its angles is provided with a plurality of apertured lugs or ears 9, by means of which the bar may be securely fastened to the brush block." This is just simply fastening the scraper by three screws to the head of the broom.

The '888 Vosbikian Patent which issued in 1955 is a detachable bracket for mops with cleaning material. This is simply a rectangular bracket for holding bristle broom brushes and contains a screw mechanism by which it is attached to the sponge mop portion.

The '152 Vosbikian Patent which issued in 1959 is dealing with mops with replaceable mop heads and an extractor mechanism. This essentially involves attachment of a brush to a sponge mop and consists of a metal bracket with bolts through it which are fastened by wing nuts.

The Zottola Patent deals with a mop with a cam wringer and also has a method of attaching a brush to the cam wringing portion of the mop. Specifically, the focus of this invention deals with plate 60 which carries brush 22. Plate 60 is secured to plate 41 which has the cam action wringer for the sponge mop through means of bolts passing through the brush 22, plate 60 and plate 41 held in position by knurled nuts 69 and 70.

The Burkhart Patent discloses a wringer sponge mop and scrubber attachment, the scrubber attachment carrying a detachable scrubber pad. Referring to Column 2 beginning on Line 46, the patent states "The scrubber attachment 40 in the embodiment illustrated at FIGS. 1 to 4 is defined by rigid bent wire 46, either integral or of several wire pieces welded together, such that the end portions of the scrubber attachment 40 define a U-portions 47 over which the channel member 42 may be slid. Each one of a pair of arm members extending from U-loop portions 47 includes a loop 48, to thereby define an apertured ear, each loop 48 terminating in an extending arm portion 50. The portions 46, 48, and 50 define a rigid frame member . . . . As illustrated in FIG. 4, the pad carrying channel member 42 is slidable on and off of wire frame 45." With respect to the second embodiment most notably illustrated in FIG. 7, the scrubber attachment 100 includes a horizontal run 102 of stiff wire. The numeral 120 denotes a stiff, sheet metal base having a central, longitudinal running channel 122 and longitudinally running overhanging flanges 124 to provide stiffness to the base. Therefore, the wire is slid into this base for purposes of attaching the scrubber.

The O'Neil, Jr. Patent deals with a sponge mop with a scrubber attachment. It includes a scrubber attachment fixedly mounted to a wringer type sponge mop without the necessity for any extra attaching hardware. The scrubber attachment carries a scrubber pad that is secured to the mop head at a predetermined angle. The attachment is best illustrated in FIG. 4 wherein the attachment 40 consists of a plastic plate or sheet. It also includes a pair of ears 46 having a central aperture through which the axles of the sponge mop protrude as illustrated in the cross-sectional views of FIGS. 2 and 3.

The Jones Patent discloses a design patent for a wringer mop head with a scrubber.

The Decoopman Patent deals with a sponge mop. The device includes a scraper as illustrated in FIGS. 13 and 14. The scraper includes a pad 47 secured to the support plate which in turn is fit into a cylindrical member by means of the portion they called finger 49. Referring to Column 10, line 59, the patent states "In order to avoid any untimely disconnection of the pad 47 from the support plate 48, the rail 58 projecting from the front face of said support plate 48 advantageously has a first abutment face 60 situated at one end and a first portion 61 of a snap-fastening system situated near its opposite end. The groove 59 in the rear face of the backing plate 57 then has a second abutment face 62 situated at one end and a second portion 63 of the same snap-fastening system situated towards its opposite. The pad is mounted on the support plate 48 by causing the groove 59 to slide on the projecting rail 58. The sliding is continued until the first and second abutment faces 60 and 62 and also the first and second portions of the snap-fastening system 61, 63 co-operate mutually so as to hold the pad locked in position."

The '750 Vosbikian Patent deals with a sponge mop attachment. The device which holds the scrubber is best illustrated in FIGS. 3 through 9 and includes two detent tabs 14 and 15 which fit into cutouts in the mops 10 and 11. Also, there are openings 19 and 18 to receive a front tip of the squeeze arms 6 and 7.

The '775 Petner Patent appears to have the same structural features of the previous Vosbikian Patent with respect to the attachment of the scrubber, although it does not have the front housing to which the scrubber is attached as in the Vosbikian Patent.

The '378 Petner Patent discloses a self-wringing swap mop with a scrubber. Referring to Column 3, line 24, it states "Attached to flat outer surface 24 is an abrasive scrubber member 26. It will be appreciated that scrubber member 26 can be an abrasive pad, brush or similar course surface which can be permanently attached to the outer surface 24 or attached by means of Velcro."

The Lewis Patent is a mop scrubber adapter. Referring particularly to Column 3, line 32, the patent states "As best shown in FIG. 3, the scrubber adapter 10 has detent tabs 40 which fit the sides and front of the head attachment 16. Two arms 44 extend rearwardly from the scrubber adapter 10, each arm having a side detent tab 40 at an end thereof. In the illustrated embodiment, the side detent tabs 40 are sized for insertion into a notch 48 of the head attachment A front detent tab 50 extends rearwardly from the adapter 10 and is sized to extend from a lower rear edge 52 of the head attachment 16."

The Reissue Petner Patent is a cam actuated roller mop with a scrubber attachment. The mop is combined with an integral mop attachment with an outer abrasive surface, designed and formed to be positioned within a wall surface. The attachment is removable and interchangeable for use on similarly configured roller mops. Referring to Column 4, line 60, the patent states "Frame 14 further preferably supports a removable floor scrubbing mop attachment 20 which has a planar abrasive scrubbing surface 24 as illustrated best in FIGS. 1 and 11." Referring to Column 5, line 18, the patent further states "As seen FIG. 11, removable mop attachment 20 includes a planar support panel 74 and is maintained in position in tunnel housing 42 of frame 14 by side support guides 76 and a central support stop 78, all of which are preferably integrally molded with mop attachment 20 as a single piece of plastic."

The Laux Patent relates to a modular sponge mop. The sponge mop is retained on a backing plate. Referring to Column 3 beginning on line 55, it states "As may best be seen in FIGS. 2 and 8, the backing plate 52 further includes a pair of spaced legs 70, 72 located adjacent opposing lateral sides of the backing plate 52. The legs 70, 72 are adapted to slide through corresponding slots 74, 76 extending into the front edge 18 from the lower side thereof. In addition, each of the legs 70, 72 includes a respective tang portion 78, 80 extending perpendicularly thereto. The tang portions 78, 80 engage a back surface 82 (FIG. 3) of the front edge 18 whereby the backing plate 52 is held in contact with the front edge 18 as it is inserted upwardly to engage the legs 70, 72 within the slots 74, 76."

The Fernandez Patent is a roller self-wringing sponge mop with a scrubber. The scrubber designated as 42 is provided on the narrow end of the mop head 14. The scrubber/scraper 42 includes a scrubbing material 42*a* and scraper edge 42*b*. The scrubber/scraper 42 is attached to the mop head 14 in a removable manner such as by projections that slide within undercuts on the end of the mop head 14 and are held tightly by an interference fit.

The Libman Patent Application is a published application which was published on Jan. 29, 2004. This patent application discloses a slot arrangement for retaining a working brush. Referring to Section 46 of the application, it states "For further convenience, the working end 24 of the mop can be provided with a removable brush 92. The brush illustrated in FIG. 22 has a slotted resilient web 93 that fits within a sleeve 95 on the working end of the mop (FIG. 21). The web comprises a depression 97 that engages an internal knob 99 in the sleeve to hold the brush in place."

The European Patent Application is in effect the European publication of the Libman Patent is disclosed above. This is the reason that the application was published. It effectively discloses the same thing as just discussed in the U.S. Libman patent publication.

The Oretti Patent is a butterfly sponge mop with an angle-adjustable handle. The patent also discloses an auxiliary cleaning tool and the method by which it is attached as best illustrated in FIG. 7. Referring to Column 6, the patent states "The illustrated embodiment of the present invention also includes means for selectively mounting an auxiliary cleaning tool 70, such as a scourer or a squeegee, on the front of the body portion 40 of the swivel housing 34. As illustrated in FIGS. 4 and 7, the auxiliary cleaning too 70 is mounted by a mounting plate 72 provided on the auxiliary cleaning tool 70 that is slidably lockable in a complementary key structure 74 formed in the front of the body portion 40."

Going to line 51, the Oretti Patent states "The key structure 74 is advantageously molded of a plastic material such as polypropylene or polyethylene and may be designed and configured to positively permanently snap-fit to the body portion 40 of the swivel housing 34." Also, referring to Column 7 and in particular, FIG. 8, the patent states "The forward edge of the cover 624 is provided with a key structure 626 for securing a tool mounting plate 550. The tool mounting plate has integral slide elements 552, 554 and 556 which cooperate with the key structure 626 to secure the mounting plate to the front of the pivot mop assembly."

The Slany Patent is a design patent that has a scrubber attached to the mop shaft.

The WO 01/03566 A1 Patent, this is the same as the United States Patent to Petner discussed as the Reissue Patent with the scrubber on the self wringing mop.

There is a significant need for an improved attachment mechanism to removably and securely retain a cleaning implement such as a scrubber pad or scrub brush on a wringer mop.

SUMMARY OF THE INVENTION

The present invention is a cleaning implement such as a scrubber pad attachment which removably holds the scrubber pad or scrub brush attachment which holds a scrub brush in place on a wringer mop head and will not fall off during the vigorous scrubbing action because it is locked in place by means of a novel attaching mechanism. The present invention is comprised of a receiving channel affixed to the mop head, the channel receiving the unique locking members of the present invention attachment mechanism. The attachment comprises an elongated base member which on one side either permanently or removably retains a scrubber pad or permanently retains a scrub brush. On the opposite side, the base comprises the locking members which are three snap wings, one extending in one direction and the other two extending in the opposite direction, so that when the snap wings are received within the receiving channel, the snap wings are snapped into and retained within the receiving channel with the wings abutting opposite elongated interior walls within the receiving channel to lock the base in place within the channel.

It has been discovered, according to the present invention, that if an attachment mechanism comprises a multiplicity of snap wings which can be inserted in a channel attached to a mop head, with at least one snap wing having a tooth abutting an interior wall of the channel and at last a second snap wing abutting an opposing interior wall of the channel, then the mechanism will be securely retained on the mop head and can retain a scrubber pad or scrub brush during vigorous scrubbing action.

It has further been discovered, according to the present invention, that if the mechanism further contains a pair of parallel side walls which abut respective ends of the channel walls, lateral movement of the mechanism during vigorous scrubbing will be prevented.

It has further been discovered, according to the present invention, that the preferred shape and the receiving channel walls is "L" shaped, however other wall shapes are within the spirit and scope of the present invention.

It has additionally been discovered, according to the present invention, that while three snap wings are the preferred embodiment, any configuration having at least one snap wing with a flat surface pointing in a direction and a tooth pointing in a direction combined with at least a second snap wing with a flat surface pointing in a direction opposite to the direction of the flat surface of the at least one snap wing and a tooth pointing in a direction opposite to the direction of the tooth of the at least one snap wing is within the spirit and scope of the present invention.

It is therefore an object of the present invention to have an attachment mechanism to removably and securely retain a scrubber pad and/or scrub brush attachment on a wringer mop.

It is a further object of the present invention to provide a mechanism to lock the scrubber pad or scrub brush retained into a receiving channel affixed to a mop head so that the mechanism will not move and will not fall out of the channel during a vigorous scrubbing process.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The innovation of the present invention is a scrubber pad attachment which removably holds the scrubber pad in place on a wringer mop head and will not fall off during the vigorous scrubbing action because it is locked in place by means of a novel attaching mechanism. The innovation of the present invention is also a scrub brush attachment which holds the scrub brush in place on a wringer mop head and will not fall off during the vigorous brushing action because it is locked in place by means of a novel attaching mechanism. The present invention is comprised of a receiving channel affixed to the mop head, the channel receiving the unique locking members of the present invention attachment mechanism. The attachment comprises an elongated base member which on one side either permanently or removably retains a scrubber pad or permanently retains a scrub brush. On the opposite side, the base comprises the locking members which are three snap wings, one extending in one direction and the other two extending in the opposite direction, so that when the snap wings are received within the receiving channel, the snap wings are snapped into and retained within the receiving channel with the wings abutting opposite elongated interior walls within the receiving channel to lock the base in place within the channel.

The base further comprises two transversely extending side members which are located at opposite ends of the three snap members and positioned such that when the snap members are locked within the channel, a respective transverse side member is positioned immediately outside the ends of the receiving channel so the base cannot move laterally in either direction. As a result, the base is firmly locked within the receiving channel and won't move during vigorous scrubbing action.

Figure 1:
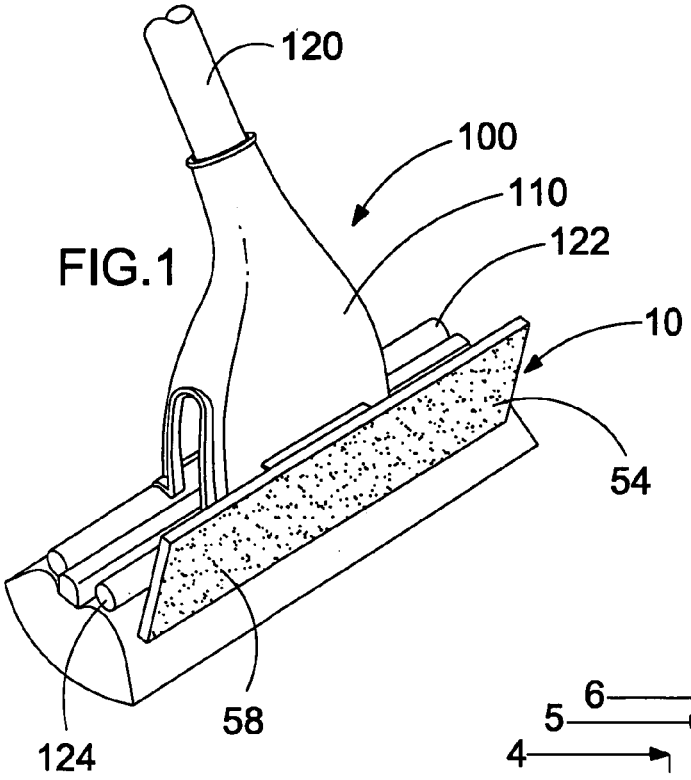
FIG. 1 is a perspective view of the head portion of a wringer mop with the scrubber pad retained on the mop head through the present invention.
Figure 2:
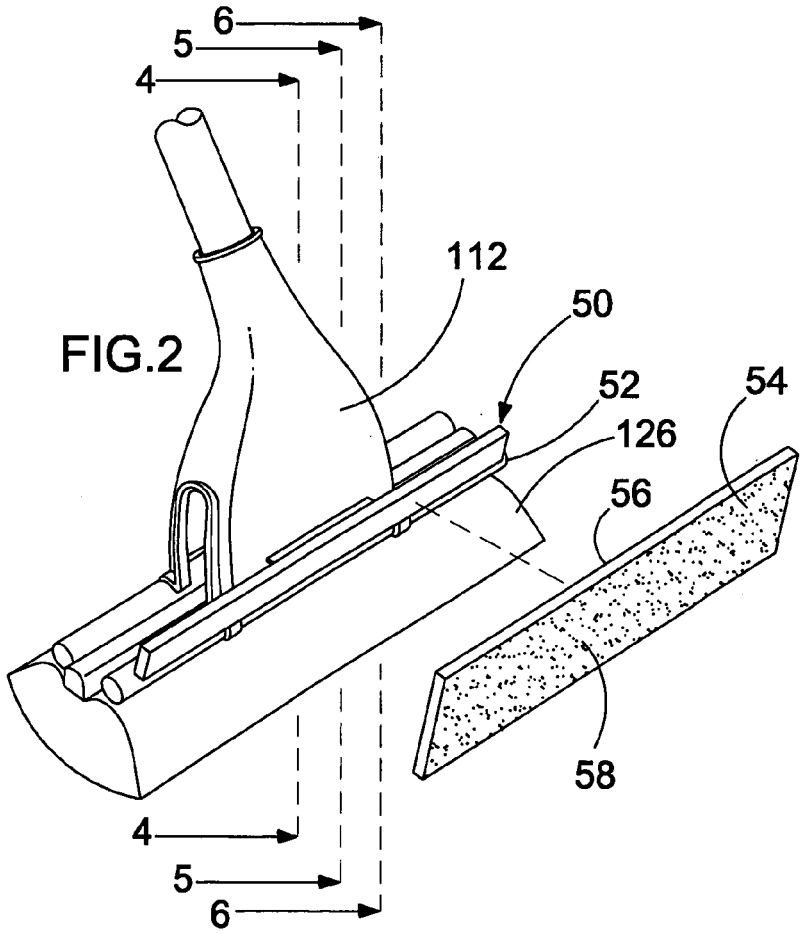
FIG. 2 is an exploded perspective view of the head portion of a wringer mop with the scrubber pad removed from the present invention.
Figure 3:
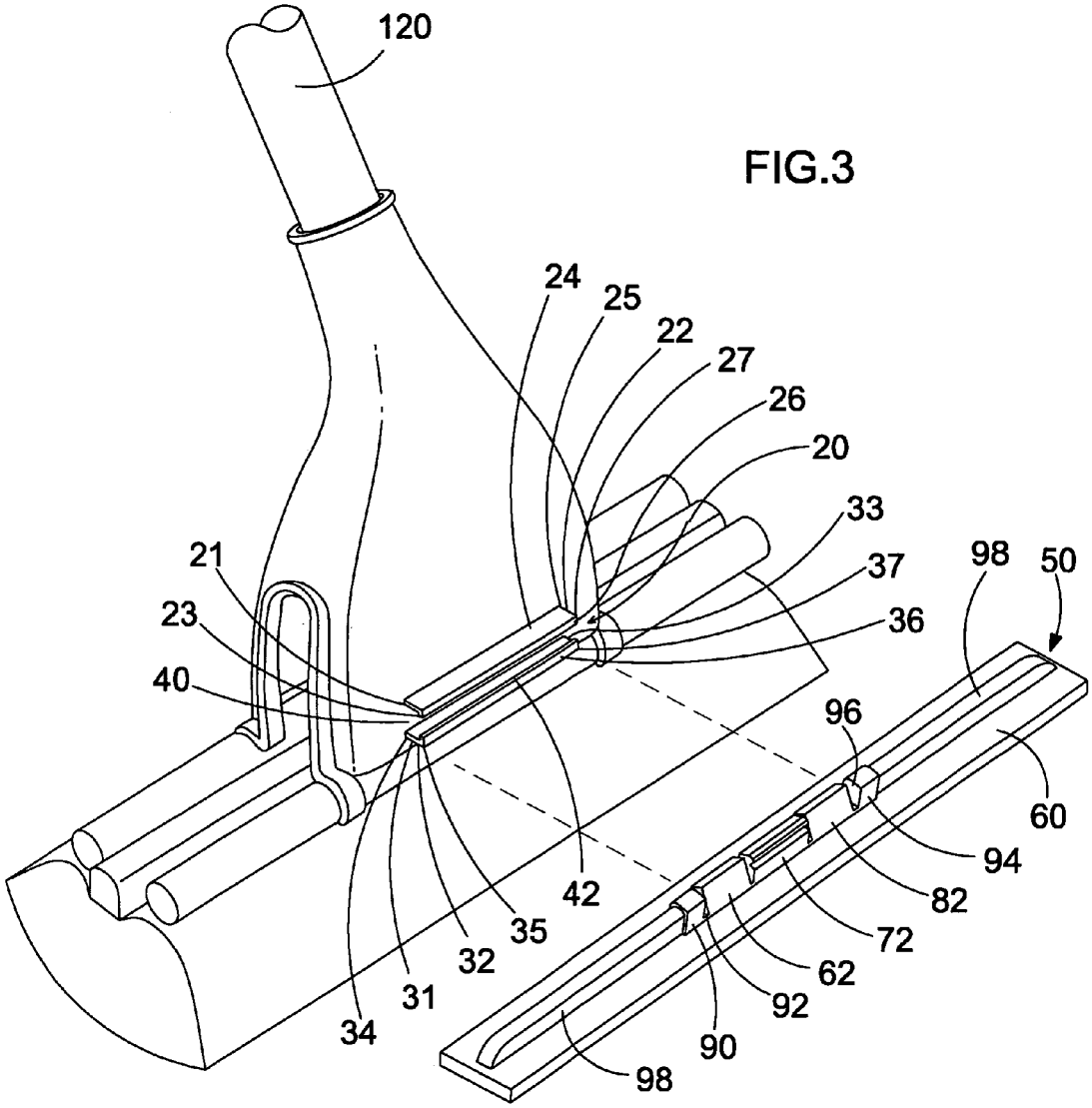
FIG. 3 is an exploded perspective view of the present invention scrubber pad attachment removed from the mop head to reveal the retaining channel on the mop head and the attachment means on the base portion of the scrubber pad attachment.

Referring to FIGS. 1, 2 and 3, there is illustrated at 100 the head portion of a wringer mop which includes the head 110, a portion of the shaft 120 by which the wringer mop is held and the sponge roller plates 122 and 124 by which the sponge 126 is wrung. The head 110 has a front surface 112 elevated above the front sponge roller plate 124 on which a scrubber pad attachment is conventionally placed so that the shaft 120 and head 110 can be positioned to cause a retained scrubber pad to apply abrasive pressure to difficult soil areas which will not come loose through ordinary washing with the sponge 126.

The present invention attachment mechanism 10 addresses the problem found in conventional scrubber attachment mechanisms which come loose from the head 110 because of vigorous scrubbing action required to loosen the ingrained soil areas. The present invention attachment mechanism 10 comprises a receiving member 20 which has a first "L shaped wall 22 which includes a first sidewall 24 attached to or molded into the head 110 at one end and terminating in a first transverse wall 26 at its other end.

The receiving member 20 further comprises a second "L" shaped wall 32 which includes a second sidewall 34 attached to or molded into the head 110 at one end and terminating in a second transverse wall 36 at its other end. The first "L" shaped wall 22 and the second "L" shaped wall 32 are mirror images of each other so that they are spaced apart with first sidewall aligned parallel to second sidewall 34 and first transverse wall 26 extending toward second transverse wall 36 and second transverse wall 36 extending toward first transverse wall 26 so that a channel 40 is formed between first sidewall 24 and second sidewall 34 and an elongated gap 42 is formed between first transverse wall 26 and second transverse wall 36 which leads into channel 40.

The second component of the present invention attachment mechanism is an elongated base 50 having a front side 52 to which a scrubber pad 54 is attached. The scrubber pad 54 can be permanently attached to the front side 52 of elongated base 50 by adhesive means or alternatively, the scrubber pad 54 can be removably attached to the front side 52 of elongated base 50 by removable attachment means such as Velcro® hook and loop fasteners with one hook or loop fastener positioned on the front side 52 of elongated base 50 and the mating loop or hook fastener positioned in the rear surface 56 of scrubber pad 54. When affixed to the base 50 in this manner, the abrasive face 58 of scrubber pad 54 faces outwardly as illustrated in FIG. 1 so that the abrasive face 58 of scrubber pad 54 can be rubbed against the wall or floor being washed.

Figure 4:
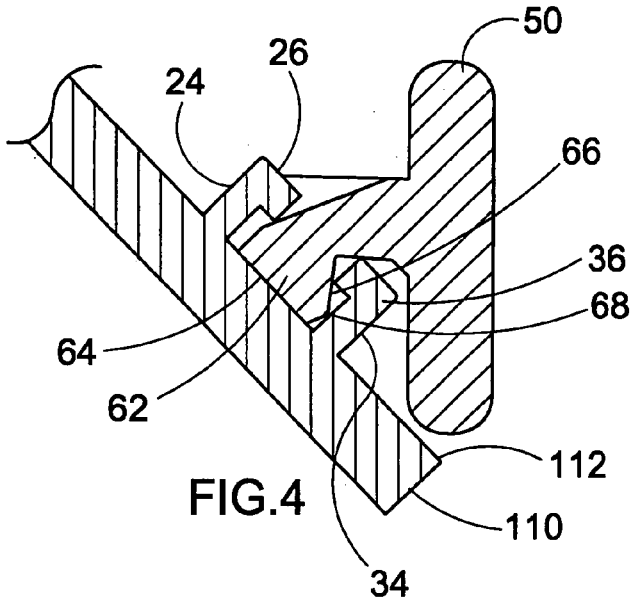
FIG. 4 is a cross-sectional view taken along Line 4-4 of FIG. 2.

The rear side 60 of elongated base 50 contains the locking members which are three snap wings. A first snap wing 62 is illustrated in FIGS. 3 and 4 and comprise a flat surface 64 and tooth surface 66 having a tooth 68 formed by sections of the surface coming together to form a tooth 68.

Figure 5:
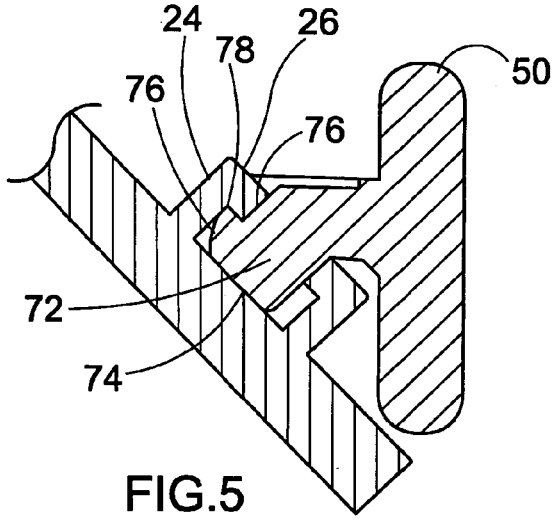
FIG. 5 is a cross-sectional view taken along Line 5-5 of FIG. 2.

Adjacent first snap wing 62 is second snap wing 72 which is illustrated in FIGS. 3 and 5 and comprises a flat surface 74 and a tooth surface 76 having a tooth 78 formed by sections of the surface coming together to form a tooth 78.

Figure 6:
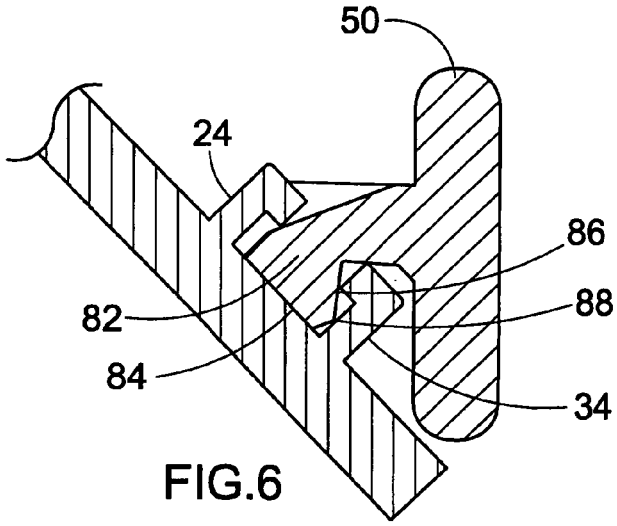
FIG. 6 is a cross-sectional view taken along Line 6-6 of FIG. 2.

Adjacent second snap wing 72 at its opposite end is third snap wing 82 which is illustrated in FIGS. 3 and 6 and comprises flat surface 84 and a tooth surface 86 having a tooth formed by sections of the surface coming together to form a tooth 88.

First snap wing 62 is identical to third snap wing 82 with their respective teeth 68 and 88 parallel to each other and pointing in the same direction and their respective flat surfaces 64 and aligned parallel. Second snap wing 72 is between and adjacent to first snap wing 62 and third snap wing 82 has its tooth 78 oppositely disposed to teeth 68 and 88 and has its flat surface 74 pointing in the opposite direction to flat surfaces 64 and 84. The three snap wings 62, 72 and 82 are pushed through elongated gap 42 and are firmly secured within channel 40 with their respective flat surfaces 64, 74 and 84 resting against the head 110 of the mop wringer while their teeth 68, 78 and 88 are pressed against walls of the receiving member 20. In the embodiment illustrated teeth 68 and 86 abut the interior of second sidewall 34 while tooth 78 abuts the interior of first sidewall 24 and also rests adjacent the interior of first transverse wall 26.

It will be appreciated that numerous alternate configurations are within the spirit and scope of the present invention to have a multiplicity of snap wings to retain the elongated base within the receiving member 20. Three snap wings as illustrated with two having teeth pointing in one direction and the other having a tooth pointing in the opposite direction is preferred so that snap wings are sandwiched against first "L" shaped wall and second "L" shaped wall within channel 40 of receiving member 20. The present invention will work with any two snap wings with teeth pointing in opposite directions to abut opposing "L" shaped walls. Even at least one snap wing is within the spirit and scope of the present invention.

Adjacent the side of first snap wing 62 remote from second snap wing 72 is a first transverse side member 90 having an interior surface 92 adjacent to first snap wing 62. Adjacent the side of third snap wing 82 remote from second snap wing 72 is a second transverse side member 94 having an interior surface 96.

First sidewall 24 terminates in a first transverse end 21 and an opposite second transverse end 25 and first transverse wall 26 terminates in a first transverse end 23 and an opposite second transverse end 27. Similarly, second sidewall 34 terminates in a first transverse end 31 and an opposite second transverse end 35 and second transverse wall 26 terminates in a first end 33 and an opposite second transverse end 37. The transverse ends 21, 23, 31 and 33 are all aligned and transverse ends 25, 27, 35 and 37 are all aligned. When the three snap wings 62, 72, and 82 are press fit and snapped into and retained within channel 40, interior surface 92 of first transverse side member 90 abuts transverse ends 21, 23, 31 and 33 and interior surface 96 and second transverse side member 94 abuts transverse ends 25, 27, 35 and 37 so that elongated base 50 is firmly secured within channel 40 so that lateral and side to side movement of snap wings 62, 72 and 82 within channel 40 is prevented by first and second transverse side members 90 and 92 respectively abutting ends of receiving member 20.

Therefore, through implementation of the present invention attachment mechanism, the scrubber pad assembly is very securely retained on the mop head and will not fall out because the snap wings securely retain the elongated base member within the receiving channel and the transverse side members prevent lateral movement of the elongated base during vigorous scrubbing.

The present invention attachment member including the elongated base 50, the snap wings 62, 72 and 82 and transverse side members 90 and 92 can be molded as one piece and formed of plastic or related synthetic material such as polypropylene, etc. Optionally, an internal rail 98 can also be molded onto the rear surface 60 of elongated base 50 and respectively positioned on the exterior sides of first and second transverse side members 90 and 94 to give them extra strength.

Although securely retained, the elongated base 50 and its snap wings or snap fasteners 62, 72 and 84 of the transverse side members 90 and 94 are removable from receiving channel and can be replaced if necessary.

Figure 7:
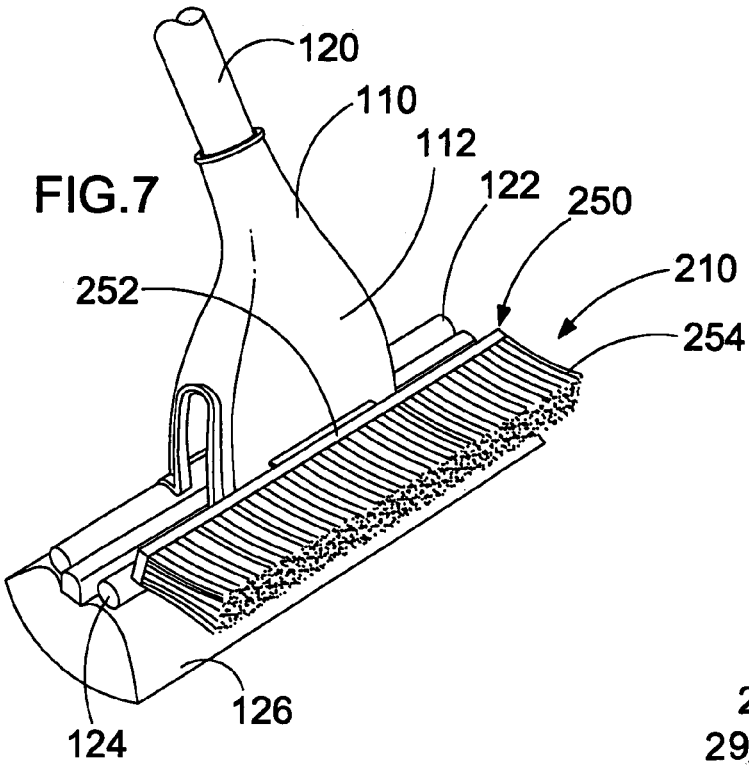
FIG. 7 is a perspective view of the head portion of a wringer mop with the scrub brush retained on the mop through the present invention.
Figure 8:
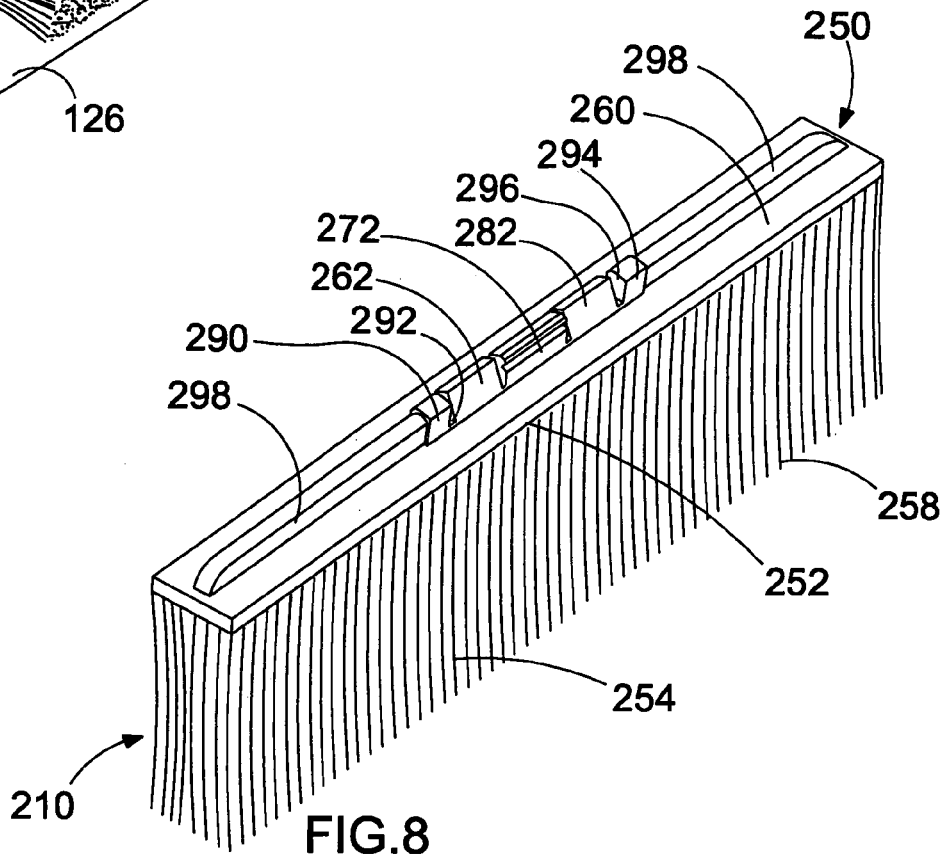
FIG. 8 is a perspective view of the scrub brush attachment after it has been removed from the mop head to reveal the attachment means on the base portion of the scrub brush attachment.

Referring to FIGS. 3, 7 and 8, there is illustrated the head portion of a wringer mop which includes the head 110, a portion of the shaft 120 by which the wringer mop is held and the sponge roller plates 122 and 124 by which the sponge 126 is wrung. The head 110 has a front surface 112 elevated above the front sponge roller plate 124 on which a scrub brush attachment is conventionally placed so that the shaft 120 and head 110 can be positioned to cause a retained scrub brush to apply brushing pressure to difficult soil areas which will not come loose through ordinary washing with the sponge 126.

This alternative embodiment of the present invention attachment mechanism 210 addresses the problem found in conventional scrubber attachment mechanisms which come loose from the head 110 because of vigorous brushing action required to loosen the ingrained soil areas. The present invention attachment mechanism 210 comprises a receiving member 20 which has a first "L shaped wall 22 which includes a first sidewall 24 attached to or molded into the head 110 at one end and terminating in a first transverse wall 26 at its other end.

The receiving member 20 further comprises a second "L" shaped wall 32 which includes a second sidewall 34 attached to or molded into the head 110 at one end and terminating in a second transverse wall 36 at its other end. The first "L" shaped wall 22 and the second "L" shaped wall 32 are mirror images of each other so that they are spaced apart with first sidewall aligned parallel to second sidewall 34 and first transverse wall 26 extending toward second transverse wall 36 and second transverse wall 36 extending toward first transverse wall 26 so that a channel 40 is formed between first sidewall 24 and second sidewall 34 and an elongated gap 42 is formed between first transverse wall 26 and second transverse wall 36 which leads into channel 40.

The second component of the alternative embodiment of the present invention attachment mechanism is an elongated base 250 having a front side 252 to which a scrub brush 254 is attached. The scrub brush 254 is permanently attached to the front side 252 of elongated base When affixed to the base 250 in this manner, the brushes 258 face outwardly as illustrated in FIG. 7 so that the brushes 250 of the scrub brush 254 can be brushed against the wall or floor being washed.

The rear side 260 of elongated base 250 contains the locking members which are three snap wings. A first snap wing 262 is illustrated in FIG. 8 and comprises a flat surface and tooth surface having a tooth formed by sections of the surface coming together to form a tooth, comparable to flat surface 64 and tooth surface 66 with tooth 68 as illustrated in FIG. 4.

Adjacent first snap wing 262 is second snap wing 272 which is illustrated in FIG. 8 and comprises a flat surface and a tooth surface having a tooth formed by sections of the surface coming together to form a tooth, comparable to flat surface 74, tooth surface 76 and tooth 78 as illustrated in FIG. 5.

Adjacent second snap wing 272 at its opposite end is third snap wing 282 which is illustrated in FIG. 8 and comprises a flat surface and a tooth surface having a tooth formed by sections of the surface coming together to form a tooth, comparable to flat surface 84, tooth surface 86 and tooth 88 as illustrated in FIG. 6.

First snap wing 262 is identical to third snap wing 282 with their respective teeth parallel to each other and pointing in the same direction and their respective flat surfaces aligned parallel. Second snap wing 272 is between and adjacent to first snap wing 262 and third snap wing 282 has its tooth oppositely disposed to the teeth of snap wings 262 and 282 and has its flat surface pointing in the opposite direction to flat surfaces of snap wings 262 and 282. The three snap wings 262, 272 and 282 are pushed through elongated gap 42 and are firmly secured within channel 40 with their respective flat surfaces resting against the head 110 of the mop wringer while their teeth are pressed against walls of the receiving member 20.

It will be appreciated that numerous alternate configurations are within the spirit and scope of the present invention to have a multiplicity of snap wings to retain the elongated base 250 within the receiving member 20. Three snap wings as illustrated with two having teeth pointing in one direction and the other having a tooth pointing in the opposite direction is preferred so that snap wings are sandwiched against first "L" shaped wall and second "L" shaped wall within channel 40 of receiving member 20. The present invention will work with any two snap wings with teeth pointing in opposite directions to abut opposing "L" shaped walls. Even at least one snap wing is within the spirit and scope of the present invention.

Adjacent the side of first snap wing 262 remote from second snap wing 272 is a first transverse side member 290 having an interior surface 292 adjacent to first snap wing 262. Adjacent the side of third snap wing 282 remote from second snap wing 272 is a second transverse side member 294 having an interior surface 296.

First sidewall 24 terminates in a first transverse end 21 and an opposite second transverse end 25 and first transverse wall 26 terminates in a first transverse end 23 and an opposite second transverse end 27. Similarly, second sidewall 34 terminates in a first transverse end 31 and an opposite second transverse end 35 and second transverse wall 26 terminates in a first end 33 and an opposite second transverse end 37. The transverse ends 21, 23, 31 and 33 are all aligned and transverse ends 25, 27, 35 and 37 are all aligned. When the three snap wings 262, 272, and 282 are press fit and snapped into and retained within channel 40, interior surface 292 of first transverse side member 290 abuts transverse ends 21, 23, 31 and 33 and interior surface 296 and second transverse side member 294 abuts transverse ends 25, 27, 35 and 37 so that elongated base 250 is firmly secured within channel 40 so that lateral and side to side movement of snap wings 262, 272 and 282 within channel 40 is prevented by first and second transverse side members 290 and 292 respectively abutting ends of receiving member 20.

Therefore, through implementation of the present invention attachment mechanism, the scrub brush assembly is very securely retained on the mop head and will not fall out because the snap wings securely retain the elongated base member within the receiving channel and the transverse side members prevent lateral movement of the elongated base during vigorous scrubbing.

The present invention attachment member including the elongated base 250, the snap wings 262, 272 and 282 and transverse side members 290 and 292 can be molded as one piece and formed of plastic or related synthetic material such as polypropylene, etc. Optionally, an internal rail 298 can also be molded onto the rear surface 260 of elongated base 250 and respectively positioned on the exterior sides of first and second transverse side members 290 and 294 to give them extra strength.

Although securely retained, the elongated base 250 and its snap wings or snap fasteners 262, 272 and 282 of the transverse side members 290 and 294 are removable from receiving channel 20 and can be replaced if necessary.

Defined in detail, the present invention is an attachment mechanism to retain a cleaning implement attachment on a wringer mop including a head having a front surface, the attachment mechanism comprising: (a) a receiving member attached to the front surface of the mop head, the receiving member further comprising a first "L" shaped wall having a first sidewall attached to the mop head at one end and terminating in a first transverse wall at its other end, the first sidewall having first and second transverse ends and the first transverse wall having first and second transverse ends, and a second "L" shaped wall having a second sidewall attached to the mop head at one end and terminating in a second transverse wall at its other end, the second sidewall having first and second transverse ends, and the second transverse wall having first and second transverse ends, the first and second "L" shaped walls being spaced apart and parallel to each other and a mirror image of each other so that the first sidewall is parallel to the second sidewall and the first and second transverse walls extend toward each other with an elongated gap separating them and leading to an internal channel formed by the first and second "L" shaped walls; (b) an elongated base having a front side to which a cleaning implement is attached, and a rear side comprising a first snap wing extending away from the side of the elongated base, the first snap wing having a flat surface and a tooth surface having a tooth, a second snap wing aligned with and adjacent the first snap wing, the second snap wing extending away from the rear side of the elongated base and having a flat surface and a tooth surface having a tooth, and a third snap wing aligned with and adjacent the second snap wing, the third snap wing extending away from the rear side of the elongated base and having a flat surface and a tooth surface having a tooth; (c) the first and third snap wings being parallel to each other with their respective flat surface extending in the same direction and their respective teeth extending in the same direction, the second snap wing positioned between the first and third snap wings with the flat surface of the second snap wing extending in an opposite direction to the flat surfaces of the first and third snap wings and the tooth of the second snap wing extending in the opposite direction to the teeth of the first and third snap wings; (d) a first transverse side member extending away from the rear surface of the elongated base member and having an interior surface located adjacent an end of the first snap wing remote from the second snap wing and a parallel second transverse side member extending away from the rear surface of the elongated base member and having an interior surface located adjacent an end of the third snap wing remote from the second snap wing; (e) the three snap wings insertable into the channel of the receiving member by being pushed through the elongated gap so that their respective flat surfaces abut the front surface of the mop head and the tooth of the first snap member and the tooth of the third snap member abutting interior prongs of the second "L" shaped wall and the tooth of the second snap member abutting an interior portion of the first "L" shaped wall, the interior surface of the first transverse side member abutting the first transverse ends of the first "L" shaped wall and the second "L" shaped wall and the interior surface of the second transverse side member abutting the second transverse ends of the first "L" shaped wall and the second "L" shaped wall; (f) whereby the attachment mechanism is securely retained within the receiving member and the three snap wings prevent the attachment mechanism from being pulled out of the receiving channel and the two transverse side members prevent lateral movement of the snap wings within the channel.

Defined broadly, the present invention is an attachment mechanism to retain a cleaning implement attachment on a wringer mop including a head having a front surface, the attachment mechanism comprising: (a) a receiving member attached to the front surface of the mop head and formed of a pair of parallel spaced apart "L" shaped walls each having a sidewall attached at one end to the mop head and having a transverse wall at its opposite elongated end, the transverse walls extending toward each other with a gap between them, the two "L" shaped walls forming an internal channel between them which is connected to the gap, the "L" shaped walls having first and second transverse ends; (b) an elongated base having a front side to which a cleaning implement is attached, and a rear side comprising three aligned snap wings, a first and third snap wing separated by a second snap wing positioned between them, the first and third snap wings each having a flat surface extending in the same direction, the second snap wing having a flat surface and a direction opposite to the flat surface of the first and third snap wings, the first and third snap wings each having a tooth extending in the same direction and the second snap wing having a tooth extending in the opposite direction; (c) the rear side of the elongated base further comprising a pair of parallel transverse side members, respectively located adjacent one end of the first snap wing and one end of the third snap wing; and (d) the three snap wings insertable into the channel of the receiving member by being pushed through the gap so that they are firmly secured within the channel with a surface of each snap member abutting the mop head, and each respective tooth of the first and third snap members abutting an interior portion of one "L" shaped wall and the tooth of the second snap member abutting an interior portion of the other "L" shaped wall, the parallel transverse side members respectively abutting the first and second transverse ends of the "L" shaped walls; (e) whereby the attached mechanism is securely retained within the receiving member and the three snap wings prevent the attachment member from being pulled out of the channel and the two transverse side members prevent lateral movement of the snap wings within the channel.

Defined more broadly, the present invention is an attachment mechanism to retain a cleaning implement attachment on a mop including a head having a front surface, the attachment mechanism comprising: (a) a receiving member attached to the front surface of the mop head and formed of a pair of parallel spaced apart "L" shaped walls each having a sidewall attached at one end to the mop head and having a transverse wall at its opposite elongated end the transverse walls extending toward each other with a gap between them, the two "L" shaped walls forming an internal channel between them which is connected to the gap, the "L" shaped walls having first and second transverse ends; (b) an elongated base having a front side to which a cleaning implement is attached, and a rear side comprising a multiplicity of snap wings with at least one snap wing having a flat surface and a tooth extending in one direction and at least a second snap wing having a flat surface extending in a direction opposite to the flat surface of the at least one snap wing and having a tooth extending in a direction opposite to the tooth of the at least one snap wing, the at least one snap wing and the at least second snap wing being aligned; (c) the rear side of the elongated base further comprising a pair of parallel transverse side members, respectively located adjacent one end of the at least one snap wing and one end of the at least second snap wing; and (d) the multiplicity of snap wings insertable into the channel of the receiving member by being pushed through the gap so that they are firmly secured within the channel with a surface of the at least one snap wing and at least one second snap wing abutting the mop head and the tooth of the at least one snap wing abutting an interior portion of one "L" shaped wall and the tooth of the at least second snap wing abutting an interior portion of the other "L" shaped wall, the parallel transverse side members respectively abutting the front of the transverse ends of the "L" shaped walls.

Defined even more broadly, the present invention is an attachment mechanism to retain a cleaning implement on a mop including a head having a front surface, the attachment mechanism comprising: (a) a receiving member attached to the front surface of the mop head and formed of a pair of parallel spaced apart "L" shaped walls each having a sidewall attached at one end to the mop head and having a transverse wall at its opposite elongated end the transverse walls extending toward each other with a gap between them, the two "L" shaped walls forming an internal channel between them which is connected to the gap, the "L" shaped walls having first and second transverse ends; (b) an elongated base having a front side to which a scrubber pad is attached, and a rear side comprising a multiplicity of snap wings with at least one snap wing having a flat surface and a tooth extending in one direction and at least a second snap wing having a flat surface extending in a direction opposite to the flat surface of the at least one snap wing and having a tooth extending in a direction opposite to the tooth of the at least one snap wing, the at least one snap wing and the at least second snap wing being aligned; and (c) the multiplicity of snap wings insertable into the channel of the receiving member by being pushed through the gap so that they are firmly secured within the channel with a surface of the at least one snap wing and at least one second snap wing abutting the front surface of the mop head and the tooth of the at least one snap wing abutting an interior portion of one "L" shaped wall and the tooth of the at least second snap wing abutting an interior portion of the other "L" shaped wall.

Defined even more broadly, the present invention is an attachment mechanism to retain a cleaning implement attachment on a mop including a head having a front surface, the attachment mechanism comprising: (a) a receiving channel attached to the front surface of the mop head, the receiving channel having a pair of oppositely disposed walls and having an exterior gap leading to the interior of the channel, the walls of the receiving channel having respective interior surfaces and the walls of the receiving channel having opposite transverse ends; (b) an elongated base having a front side to which a cleaning implement is attached, and a rear side comprising a multiplicity of snap wings with at least one snap wing having a flat surface and a tooth extending in one direction and at least a second snap wing having a flat surface extending in a direction opposite to the flat surface of the at least one snap wing and having a tooth extending in a direction opposite to the tooth of the at least one snap wing, the at least one snap wing and the at least second snap wing being aligned; and (c) the multiplicity of snap wings insertable into the receiving channel by being pushed through the gap so that they are firmly secured within the channel with a surface of the at least one snap wing and at least one second snap wing abutting the front surface of the mop head and the tooth of the at least one snap wing abutting an interior portion of one channel wall and the tooth of the at least second snap wing abutting an interior portion of the other channel wall.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An attachment mechanism to retain a cleaning implement attachment on a wringer mop including a head having a front surface, the attachment mechanism comprising:

a. a receiving member attached to the front surface of the mop head, the receiving member further comprising a first "L" shaped wall having a first sidewall attached to the mop head at one end and terminating in a first transverse wall at its other end, the first sidewall having first and second transverse ends and the first transverse wall having first and second transverse ends, and a second "L" shaped wall having a second sidewall attached to the mop head at one end and terminating in a second transverse wall at its other end, the second sidewall having first and second transverse ends, and the second transverse wall having first and second transverse ends, the first and second "L" shaped walls being spaced apart and parallel to each other and a mirror image of each other so that the first sidewall is parallel to the second sidewall and the first and second transverse walls extend toward each other with an elongated gap separating them and leading to an internal channel formed by the first and second "L" shaped walls;

b. an elongated base having a front side to which a cleaning implement is attached, and a rear side comprising a first snap wing extending away from the side of said elongated base, the first snap wing having a flat surface and a tooth surface having a tooth, a second snap wing aligned with and adjacent the first snap wing, the second snap wing extending away from the rear side of the elongated base and having a flat surface and a tooth surface having a tooth, and a third snap wing aligned with and adjacent the second snap wing, the third snap wing extending away from the rear side of said elongated base and having a flat surface and a tooth surface having a tooth;

c. said first and third snap wings being parallel to each other with their respective flat surface extending in the same direction and their respective teeth extending in the same direction, the second snap wing positioned between the first and third snap wings with the flat surface of the second snap wing extending in an opposite direction to the flat surfaces of the first and third snap wings and the tooth of the second snap wing extending in the opposite direction to the teeth of the first and third snap wings;

d. a first transverse side member extending away from the rear side of said elongated base and having an interior surface located adjacent an end of the first snap wing remote from the second snap wing and a parallel second transverse side member extending away from the rear side of said elongated base and having an interior surface located adjacent an end of the third snap wing remote from the second snap wing;

e. the three snap wings insertable into the channel of the receiving member by being pushed through the elongated gap so that their respective flat surfaces abut the front surface of the mop head and the tooth of the first snap wing and the tooth of the third snap wing abutting interior prongs of the second "L" shaped wall and the tooth of the second snap wing abutting an interior portion of the first "L" shaped wall, the interior surface of the first transverse side member abutting the first transverse ends of the first "L" shaped wall and the second "L" shaped wall and the interior surface of the second transverse side member abutting the second transverse ends of the first "L" shaped wall and the second "L" shaped wall;

f. whereby the base is securely retained within the receiving member and the three snap wings prevent the base from being pulled out of the receiving channel and the two transverse side members prevent lateral movement of the snap wings within the channel.

2. An attachment mechanism in accordance with claim 1, wherein the first and second "L" shaped walls are molded into the front surface of the mop head.

3. An attachment mechanism in accordance with claim 1, wherein the elongated base and its three snap wings and two transverse side members are molded as one piece.

4. An attachment mechanism in accordance with claim 3, further comprising a rail on said rear side of said elongated base, the rail located adjacent the first transverse side member opposite the side first snap wing is located and the rail located adjacent the second transverse side member opposite the side where the third snap wing is located.

5. An attachment mechanism in accordance with claim 3, wherein the elongated base, three snap wings and two transverse side members are molded out of plastic.

6. An attachment mechanism in accordance with claim 4, wherein the elongated base, three snap wings, two transverse side members and the rail are molded out of plastic.

7. An attachment mechanism in accordance with claim 1, wherein said cleaning implement is a scrubber pad.

8. An attachment mechanism in accordance with claim 7, wherein the scrubber pad is permanently affixed to the front side of said elongated base.

9. An attachment mechanism in accordance with claim 7, wherein said scrubber pad is removably affixed to the front side of said elongated base.

10. An attachment mechanism in accordance with claim 1, wherein said cleaning implement is a scrub brush.

11. An attachment mechanism in accordance with claim 1, wherein the elongated base is removably retained within the channel of the receiving member.

12. An attachment mechanism to retain a cleaning implement attachment on a wringer mop including a head having a front surface, the attachment mechanism comprising:

a. a receiving member attached to the front surface of the mop head and formed of a pair of parallel spaced apart "L" shaped walls each having a sidewall attached at one end to the mop head and having a transverse wall at its opposite elongated end, the transverse walls extending toward each other with a gap between them, the two "L" shaped walls forming an internal channel between them which is connected to the gap, the "L" shaped walls having first and second transverse ends;

b. an elongated base having a front side to which a cleaning implement is attached, and a rear side comprising three aligned snap wings, a first and third snap wing separated by a second snap wing positioned between them, the first and third snap wings each having a flat surface extending in the same direction, the second snap wing having a flat surface and a direction opposite to the flat surface of the first and third snap wings, the first and third snap wings each having a tooth extending in the same direction and the second snap wing having a tooth extending in the opposite direction;

c. the rear side of the elongated base further comprising a pair of parallel transverse side members, respectively located adjacent one end of the first snap wing and one end of the third snap wing; and d. the three snap wings insertable into the channel of the receiving member by being pushed through the gap so that they are firmly secured within the channel with a surface of each snap member abutting the mop head, and each respective tooth of the first and third snap wings abutting an interior portion of one "L" shaped wall and the tooth of the second snap wing abutting an interior portion of the other "L" shaped wall, the parallel transverse side members respectively abutting the first and second transverse ends of the "L" shaped walls;

e. whereby the base is securely retained within the receiving member and the three snap wings prevent the base from being pulled out of the channel and the two transverse side members prevent lateral movement of the snap wings within the channel.

13. An attachment mechanism in accordance with claim 12, wherein the first and second "L" shaped walls are molded into the front surface of the mop head.

14. An attachment mechanism in accordance with claim 12, wherein the elongated base and its three snap wings and two transverse side members are molded as one piece.

15. An attachment mechanism in accordance with claim 14, further comprising a rail on said rear side of said elongated base, the rail located adjacent the first transverse side member opposite the side first snap wing is located and the rail located adjacent the second transverse side member opposite the side where the third snap wing is located.

16. An attachment mechanism in accordance with claim 12, wherein the elongated base, three snap wings and two transverse side members are molded out of plastic.

17. An attachment mechanism in accordance with claim 15, wherein the elongated base, three snap wings, two transverse side members and the rail are molded out of plastic.

18. An attachment mechanism in accordance with claim 12, wherein said cleaning implement is a scrubber pad.

19. An attachment mechanism in accordance with claim 18, wherein the scrubber pad is permanently affixed to the front side of said elongated base.

20. An attachment mechanism in accordance with claim 18, wherein said scrubber pad is removably affixed to the front side of said elongated base.

21. An attachment mechanism in accordance with claim 12, wherein said cleaning implement is a scrub brush.

22. An attachment mechanism in accordance with claim 12, wherein the elongated base is removably retained within the channel of the receiving member.

23. An attachment mechanism to retain a cleaning implement attachment on a mop including a head having a front surface, the attachment mechanism comprising:

a. a receiving member attached to the front surface of the mop head and formed of a pair of parallel spaced apart "L" shaped walls each having a sidewall attached at one end to the mop head and having a transverse wall at its opposite elongated end the transverse walls extending toward each other with a gap between them, the two "L" shaped walls forming an internal channel between them which is connected to the gap, the "L" shaped walls having first and second transverse ends;

b. an elongated base having a front side to which a cleaning implement is attached, and a rear side comprising a multiplicity of snap wings with at least one snap wing having a flat surface and a tooth extending in one direction and at least a second snap wing having a flat surface extending in a direction opposite to the flat surface of the at least one snap wing and having a tooth extending in a direction opposite to the tooth of the at least one snap wing, the at least one snap wing and the at least second snap wing being aligned;

c. the rear side of the elongated base further comprising a pair of parallel transverse side members, respectively located adjacent one end of the at least one snap wing and one end of the at least second snap wing; and d. the multiplicity of snap wings insertable into the channel of the receiving member by being pushed through the gap so that they are firmly secured within the channel with a surface of the at least one snap wing and at least one second snap wing abutting the mop head and the tooth of the at least one snap wing abutting an interior portion of one "L" shaped wall and the tooth of the at least second snap wing abutting an interior portion of the other "L" shaped wall, the parallel transverse side members respectively abutting the front of said transverse ends of the "L" shaped walls.

24. An attachment mechanism in accordance with claim 23, wherein the first and second "L" shaped walls are molded into the front surface of the mop head.

25. An attachment mechanism in accordance with claim 23, wherein the elongated base and its multiplicity of snap wings and two transverse side members are molded as one piece.

26. An attachment mechanism in accordance with claim 25, further comprising a rail on said rear side of said elongated base, the rail located adjacent the first transverse side member also located adjacent the second transverse side member.

27. An attachment mechanism in accordance with claim 25, wherein the elongated base, multiplicity of snap wings and two transverse side members are molded out of plastic.

28. An attachment mechanism in accordance with claim 26, wherein the elongated base, multiplicity of snap wings, two transverse side members and the rail are molded out of plastic.

29. An attachment mechanism in accordance with claim 23, wherein said cleaning implement is a scrubber pad.

30. An attachment mechanism in accordance with claim 29, wherein the scrubber pad is permanently affixed to the front side of said elongated base.

31. An attachment mechanism in accordance with claim 29, wherein said scrubber pad is removably affixed to the front side of said elongated base.

32. An attachment mechanism in accordance with claim 23, wherein said cleaning implement is a scrub brush.

33. An attachment mechanism in accordance with claim 23, wherein the elongated base is removably retained within the receiving channel.

34. An attachment mechanism to retain a cleaning implement on a mop including a head having a front surface, the attachment mechanism comprising:

a. a receiving member attached to the front surface of the mop head and formed of a pair of parallel spaced apart "L" shaped walls each having a sidewall attached at one end to the mop head and having a transverse wall at its opposite elongated end the transverse walls extending toward each other with a gap between them, the two "L" shaped walls forming an internal channel between them which is connected to the gap, the "L" shaped walls having first and second transverse ends;

b. an elongated base having a front side to which a cleaning implement is attached, and a rear side comprising a multiplicity of snap wings with at least one snap wing having a flat surface and a tooth extending in one direction and at least a second snap wing having a flat surface extending in a direction opposite to the flat surface of the at least one snap wing and having a tooth extending in a direction opposite to the tooth of the at least one snap wing, the at least one snap wing and the at least second snap wing being aligned; and c. the multiplicity of snap wings insertable into the channel of the receiving member by being pushed through the gap so that they are firmly secured within the channel with a surface of the at least one snap wing and at least one second snap wing abutting the front surface of the mop head and the tooth of the at least one snap wing abutting an interior portion of one "L" shaped wall and the tooth of the at least second snap wing abutting an interior portion of the other "L" shaped wall.

35. An attachment mechanism in accordance with claim 34, further comprising:

a. the rear side of the elongated base further comprising a pair of parallel transverse side members, respectively located adjacent one end of the at least one snap wing and one end of the at least second snap wing; and b. the parallel transverse side members respectively abutting the first and second transverse ends of the "L" shaped walls.

36. An attachment mechanism in accordance with claim 34, wherein the first and second "L" shaped walls are molded into the front surface of the mop head.

37. An attachment mechanism in accordance with claim 35, wherein the elongated base and its snap wings and two transverse side members are molded as one piece.

38. An attachment mechanism in accordance with claim 37, further comprising a rail on said rear side of said elongated base, the rail located adjacent the first transverse side member also located adjacent the second transverse side member.

39. An attachment mechanism in accordance with claim 37, wherein the elongated base, snap wings and two transverse side members are molded out of plastic.

40. An attachment mechanism in accordance with claim 38, wherein the elongated base, snap wings, two transverse side members and the rail are molded out of plastic.

41. An attachment mechanism in accordance with claim 34, wherein said cleaning implement is a scrubber pad.

42. An attachment mechanism in accordance with claim 41, wherein the scrubber pad is permanently affixed to the front side of said elongated base.

43. An attachment mechanism in accordance with claim 41, wherein said scrubber pad is removably affixed to the front side of said elongated base.

44. An attachment mechanism in accordance with claim 34, wherein said cleaning implement is a scrub brush.

45. An attachment mechanism in accordance with claim 34, wherein the elongated base is removably retained within the channel of the receiving member.

46. An attachment mechanism to retain a cleaning implement attachment on a mop including a head having a front surface, the attachment mechanism comprising:

a. a receiving channel attached to the front surface of the mop head, the receiving channel having a pair of oppositely disposed walls and having an exterior gap leading to the interior of the channel, the walls of the receiving channel having respective interior surfaces and the walls of the receiving channel having opposite transverse ends;

b. an elongated base having a front side to which a cleaning implement is attached, and a rear side comprising a multiplicity of snap wings with at least one snap wing having a flat surface and a tooth extending in one direction and at least a second snap wing having a flat surface extending in a direction opposite to the flat surface of the at least one snap wing and having a tooth extending in a direction opposite to the tooth of the at least one snap wing, the at least one snap wing and the at least second snap wing being aligned; and c. the multiplicity of snap wings insertable into the receiving channel by being pushed through the gap so that they are firmly secured within the channel with a surface of the at least one snap wing and at least one second snap wing abutting the front surface of the mop head and the tooth of the at least one snap wing abutting an interior portion of one channel wall and the tooth of the at least second snap wing abutting an interior portion of the other channel wall.

47. An attachment mechanism in accordance with claim 46, further comprising:

a. the rear side of the elongated base further comprising a pair of parallel transverse side members, respectively located adjacent one end of the at least one snap wing and one end of the at least second snap wing; and b. the parallel transverse side members respectively abutting the transverse ends of the channel walls.

48. An attachment mechanism in accordance with claim 46, wherein the first and second channel walls are molded into the front surface of the mop head.

49. An attachment mechanism in accordance with claim 47, wherein the elongated base and its multiplicity of snap wings and two transverse side members are molded as one piece.

50. An attachment mechanism in accordance with claim 48, further comprising a rail on said rear side of said elongated base, the rail located adjacent the first transverse side member also located adjacent the second transverse side member.

51. An attachment mechanism in accordance with claim 49, wherein the elongated base, multiplicity of snap wings and two transverse side members are molded out of plastic.

52. An attachment mechanism in accordance with claim 50, wherein the elongated base, multiplicity of snap wings, two transverse side members and the rail are molded out of plastic.

53. An attachment mechanism in accordance with claim 46, wherein said cleaning implement is a scrubber pad.

54. An attachment mechanism in accordance with claim 53, wherein the scrubber pad is permanently affixed to the front side of said elongated base.

55. An attachment mechanism in accordance with claim 46, wherein said scrubber pad is removably affixed to the front side of said elongated base.

56. An attachment mechanism in accordance with claim 46, wherein said cleaning implement is a scrub brush.

57. An attachment mechanism in accordance with claim 46, wherein the elongated base is removably retained within the channel of the receiving channel.

* * * * *